US005893332A

United States Patent [19]

Vourantonis

[11] Patent Number: 5,893,332

[45] Date of Patent: Apr. 13, 1999

[54] FUR PRODUCT AND METHOD OF MAKING

[75] Inventor: Theophilis T. Vourantonis, Town of Mount Royal, Canada

[73] Assignee: Furco Canada, Montreal, Canada

[21] Appl. No.: 08/903,483

[22] Filed: Jul. 30, 1997

[51] Int. Cl.[6] ..... C14B 15/10; A41D 5/00

[52] U.S. Cl. ..... 112/475.08; 112/401; 2/65; 69/22

[58] Field of Search ..... 112/475.08, 475.09, 112/401, 440, 441, 423, 16, 20; 2/65, DIG. 2; 69/22; 428/85, 54, 57, 53

[56] References Cited

U.S. PATENT DOCUMENTS

| | | | |
|---|---|---|---|
| 4,254,507 | 3/1981 | Almett | 2/65 |
| 4,292,691 | 10/1981 | Forrest et al. | 2/65 |

FOREIGN PATENT DOCUMENTS

| | | | |
|---|---|---|---|
| 2263303 | 10/1975 | France | 69/22 |
| 2502911 | 10/1982 | France | 2/65 |
| 3632174 | 4/1988 | Germany | 2/65 |

*Primary Examiner*—Peter Nerbun
*Attorney, Agent, or Firm*—Fildes & Outland, P.C.

[57] ABSTRACT

A method of making a fur product from dressed animal pelts having fur and leather sides includes cutting the fur pelts into elongated strips of generally equal width, aligning the elongated strips alternating fur up, leather up, fur up, leather up and so on, edge sewing the aligned strips together to form a panel, cutting the sewn together panel at an angle to the edge sewn seams into elongate sections, shifting every other section longitudinally a distance generally equal to the width of the cut sections, and edge sewing the sections together to form a two sided fur blanket.

10 Claims, 3 Drawing Sheets

FUR PRODUCT AND METHOD OF MAKING

FIELD OF THE INVENTION

This invention relates to processing of dressed animal pelts used to make wearing apparel and more particularly to systematically cutting and sewing the pelts to make a reversible fur blanket that can be made into a variety of fur garments.

BACKGROUND OF THE INVENTION

It is known in the art relating to fur processing to sew dressed pelts edge to edge to form a blanket having leather on one side and fur on the other side. This blanket is fashioned or tailored into a coat or other garment. The fashioned garment is typically lined with cloth to cover the leather side.

The fashioned garment is wearable only on one side and the look of the garment is that of the animal of which the garment is made.

SUMMARY OF THE INVENTION

The present invention provides a method of making a fur product or blanket and a fur product that is reversible and that eliminates a need for a lining in a garment manufactured from the blanket.

The present invention also provides a method of making a fur product and a fur product that includes fur on both sides of the blanket which fur may or may not be the same fur.

In addition, the present invention provides a method of making a fur product and a fur product that has a pattern formed in the blanket.

Furthermore, the present invention provides a method of making a fur product and a fur product that reduces the amount of fur pelts used in a reversible garment.

Moreover, the present invention provides a method of making a fur product and a fur product that can include a non fur fabric sewn together with the fur to form a blanket that is lighter than conventional fur.

The present invention also provides a method of making a fur product and a fur product that is easily folded for storage.

In carrying out these objects and other objects and advantages of the invention a method of making a fur product, such as a blanket from which fur garments can be fashioned and tailored from dressed animal pelts having fur and leather sides, includes cutting the fur pelts into elongated strips of generally equal width. The elongated strips are aligned alternating fur up, leather up, fur up, leather up and edge sewn together to form a panel. The sewn together panel is cut, at an angle relative to the edge sewn seams of the elongated strips, into elongate sections. Every other elongate section is shifted longitudinally a distance generally equal to the width of the cut sections and the shifted elongate sections are edge sewn together to form a two sided fur blanket having a checkerboard configuration with the fur, because of its length, covering and hiding the areas of leather in the blanket. The resulting fur blanket has fur on both sides and a textured appearance.

Preferably, the fur pelts are cut into elongated strips having a width generally equal to the length of the fur on the fur side. More than one type of fur pelt can be used to give the blanket a unique appearance. When this is the case, it is desirable to shear the pelt(s) having the longer fur length to match the shortest fur length.

In one embodiment, the angle at which the elongate sections are cut is generally 90 degrees to the edge sewn seams. In another embodiment, the angle at which the elongate sections are cut is generally 45 degrees to the edge sewn seams.

In yet another embodiment, at least two different pelts are used. Herein the elongated strips are aligned alternating the types of pelts placed side by side so that one type of fur is on one side and the other type of fur is on the other side of the resulting fur blanket. A lining may be attached to the pelts before the cutting. This lining may be matched in color to the fur(s) and enhance the overall color of the fur blanket.

In yet another embodiment, both dressed pelts and fabric are used. Herein, the fabric is cut into elongated strips of a width generally equal to the width of the cut fur pelt and aligned alternating the placement of the fur and the fabric, fur, fabric, fur, fabric, and so on. The resulting fur blanket has the fur on one side and the other side is void of fur. In this embodiment, the resulting fur blanket includes half as many pelts as a conventional blanket.

These and other features and advantages of the invention will be more fully understood from the following detailed description of the invention taken together with the accompanying drawings.

DETAILED DESCRIPTION OF THE INVENTION

Figure 1:
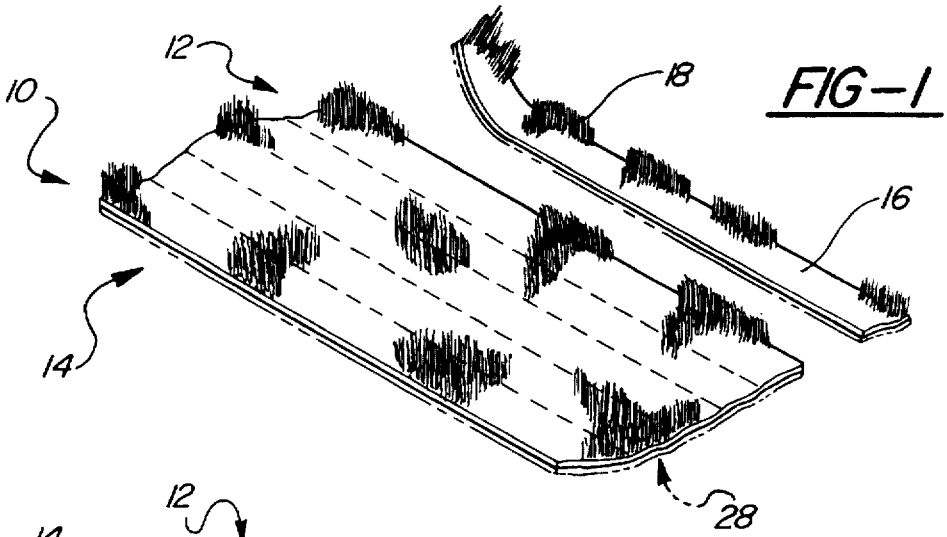
FIG. 1 is a sectional perspective view of a fur pelt cut into elongated strips in accordance with the present invention.

Referring now to the drawings in detail, there is illustrated the steps for making a fur product, or fur blanket, from which fur garments such as coats, hats and scarfs can be fashioned and tailored. As is hereinafter more fully described, the method provides a fur blanket which can be made reversible, with similar or dissimilar fur on either side, and has a visual pattern apart from the use of different fur in the blanket. The fur blanket can also include a non fur fabric sewn together with the fur to form a blanket that is lighter than conventional fur.

FIG. 1 illustrates cutting a dressed pelt 10 of an animal having fur 12 and leather 14 sides, hereinafter fur pelt, into elongated strips 16 of generally equal width. The length of hair 18 on the fur pelt 10 is used to establish the width of the strips 16. A fur pelt 10 having a shorter hair length is cut to a narrower strip width than a fur pelt having a longer hair length.

Figure 2:
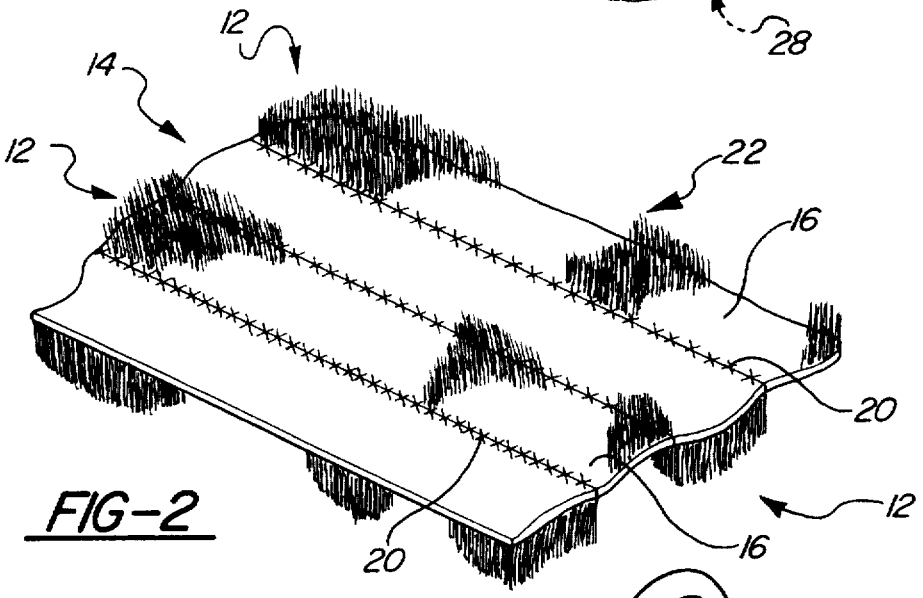
FIG. 2 is a sectional perspective view of the elongated strips aligned alternating fur up, leather up, fur up and edge sewn to form a panel in accordance with the present invention.
Figure 3:
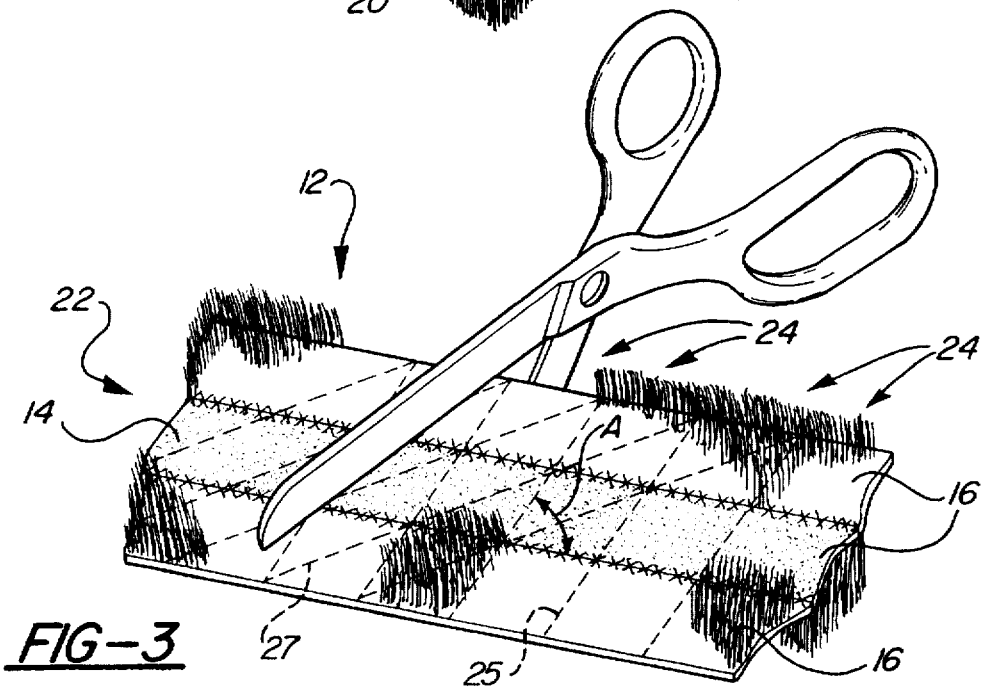
FIG. 3 is a sectional perspective view of the panel of FIG. 2 being cut into elongate sections in accordance with the present invention.

In FIG. 2, the elongated strips 16 are aligned in a pattern alternating fur up, leather up, fur up, leather up and edge sewn, forming edge sewn seams 20, together to form a panel 22. In FIG. 3, the sewn together panel 22 is cut, at an angle A, relative to the edge sewn seams 20 of the elongated strips 16, into elongate sections 24.

Figure 4:
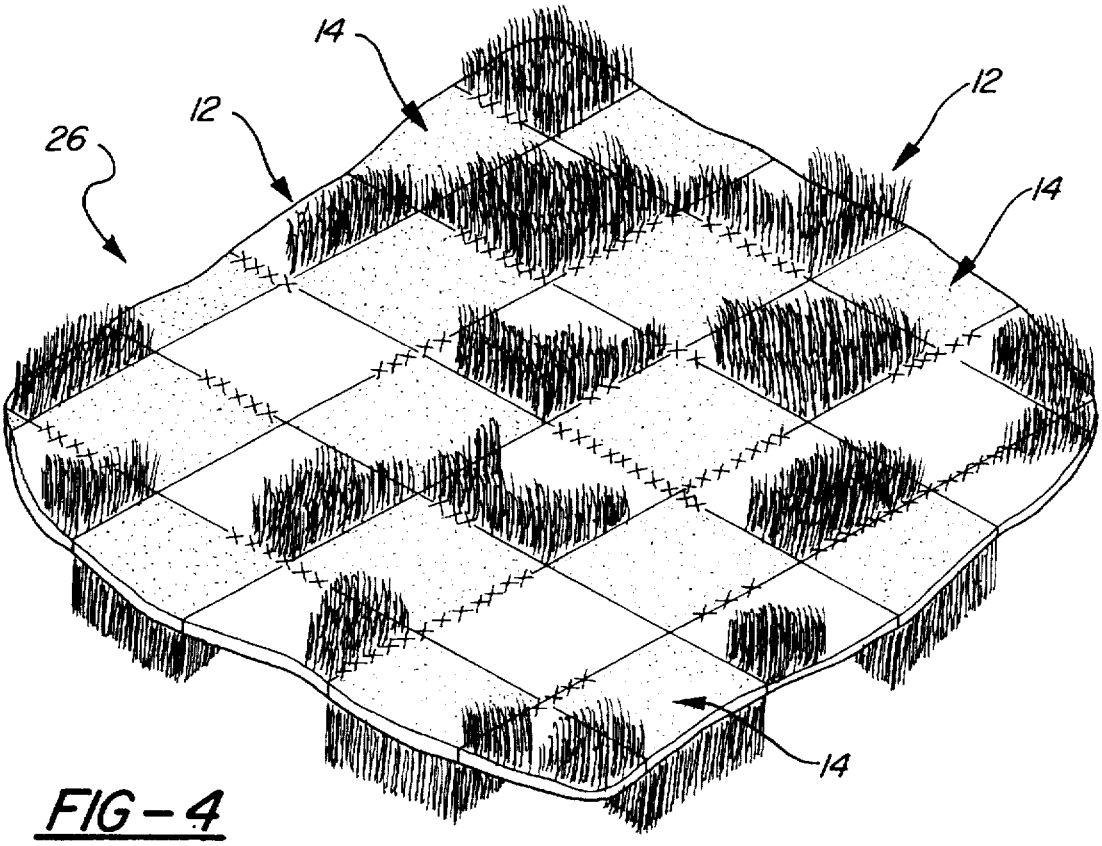
FIG. 4 is a sectional perspective view illustrating alternating elongate sections shifted longitudinally a distance generally equal to the width of the cut sections and edge sewn in accordance with the present invention to form a reversible fur blanket that can be made into apparel.

As illustrated in FIG. 4, every other elongate section 24 is shifted longitudinally a distance generally equal to the width of the cut sections and the shifted elongate sections are then edge sewn together to form a two sided fur blanket 26 having a generally checkerboard configuration with the fur, because of its length, covering and hiding the areas of leather in the blanket. The resulting fur blanket 26 has fur on both sides and a textured appearance.

More than one type of fur pelt 10 can be used to give the blanket 26 a unique appearance. When this is the case, it is desirable to shear the pelt(s) 10 having the longer fur length to match the shortest fur length.

In FIG. 3, the angle A at which the elongate sections 24 are cut is generally 90 degrees to the edge sewn seams 20 as shown by lines 25. Cutting the sections at such an angle gives the resulting blanket a checkerboard appearance. Alternatively as can be easily understood, the angle at which the elongate sections 24 can be generally 45 degrees to the edge sewn seams 20 as shown by line 27, giving the resulting blanket diamond shaped checkerboard appearance. Similarly the elongate sections can be cut at other angles to give the resulting blanket other appearances.

In another embodiment, at least two different kinds of fur pelts 10 are used. Herein the elongated strips 16 are aligned alternating the types of pelts placed side by side so that one type of fur is on one side and the other type of fur is on the other side of the resulting fur blanket. A lining 28, illustrated in phantom in FIG. 1, may be attached to the pelt(s) 10 before the cutting. This lining 28 may be matched in color to the fur(s) and enhance the overall color of the fur blanket 26.

Figure 5:
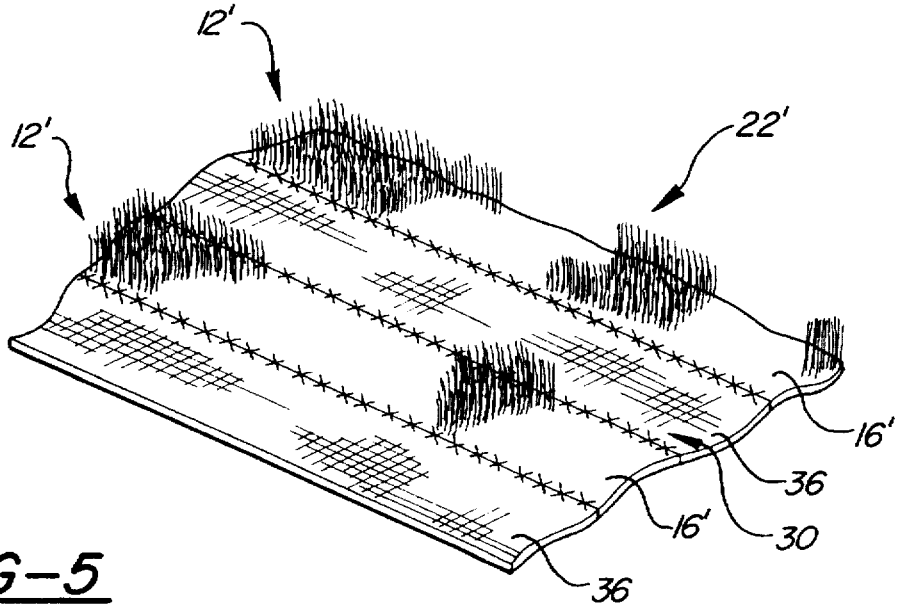
FIG. 5 is a sectional perspective view of elongated strips of pelt and elongated strips of fabric aligned alternating pelt, fabric, pelt, fabric with the fur being on one side and edge sewn to form a panel in accordance with an alternative embodiment of the present invention.
Figure 6:
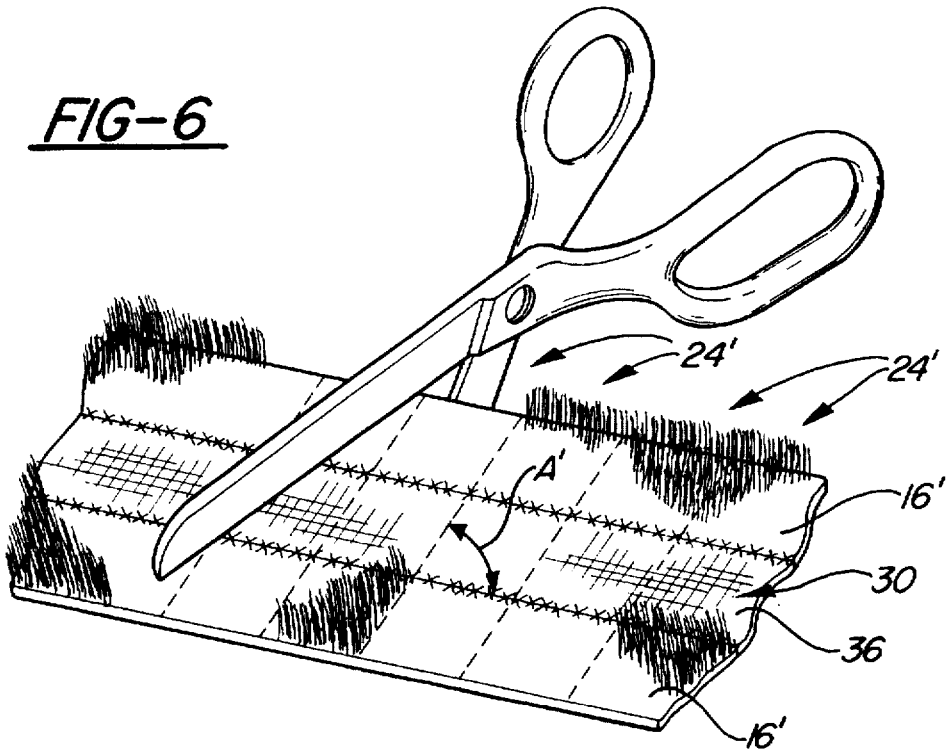
FIG. 6 is a sectional perspective view of the panel of FIG. 5 being cut into elongate sections in accordance with the present invention.
Figure 7:
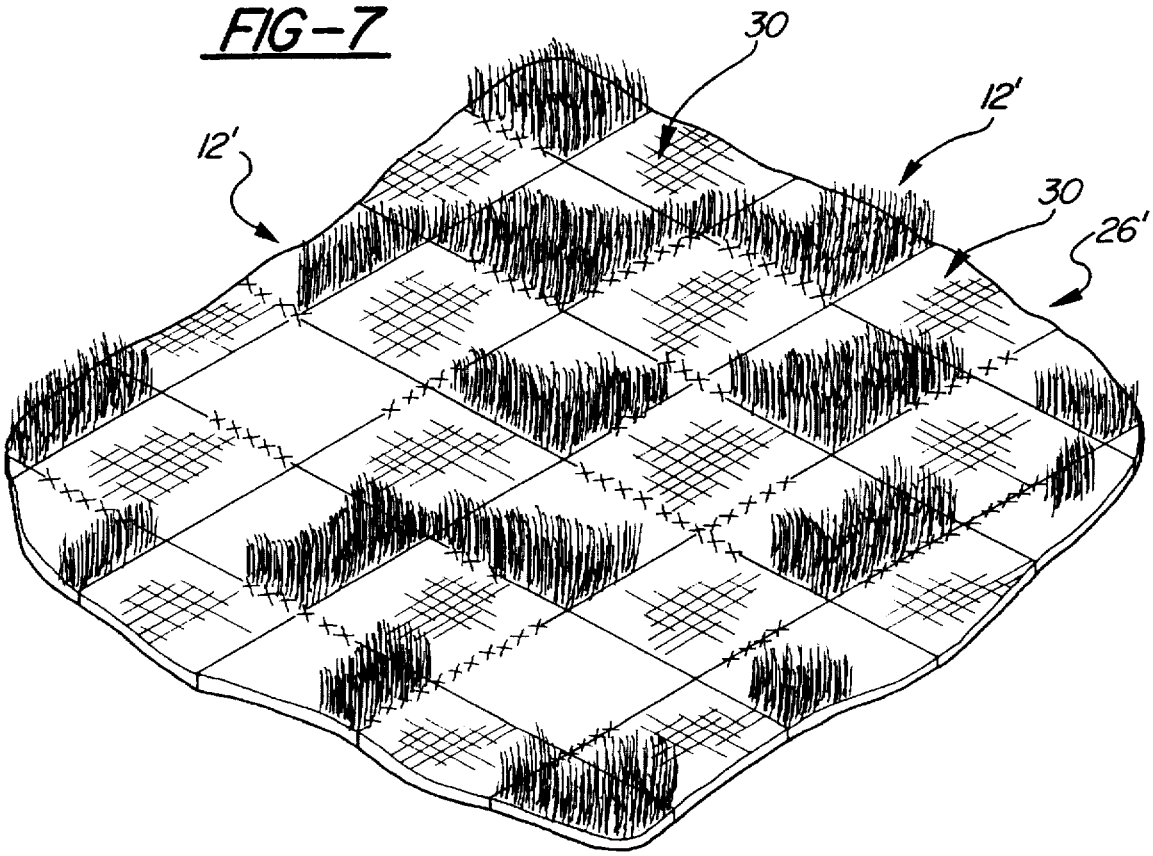
FIG. 7 is a sectional perspective view illustrating alternating elongate sections shifted longitudinally a distance generally equal to the width of the cut sections and edge sewn in accordance with the present invention to form a less weighty one sided fur blanket that can be made into apparel.

In yet another embodiment, illustrated in FIGS. 5 through 7, both dressed pelts 10 and fabric 30 are used. Herein, the fabric 30 is cut into elongated strips 36 of a width generally equal to the width of the cut fur pelt 10 and aligned alternating the placement of the fur and the fabric, fur, fabric, fur, fabric, and so on. The resulting fur blanket 26' has the fur on one side and the other side is void of fur. In this embodiment, the resulting fur blanket 26' includes half as many pelts as a conventional blanket.

Although the invention has been described by reference to specific embodiments, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A method of making a fur product from dressed animal pelts having fur and leather sides, the method comprising the steps of:

cutting the fur pelts into elongated strips of generally equal width;

aligning the elongated strips alternating fur up, leather up, fur up, leather up and so on;

edge sewing the aligned strips together to form a panel;

cutting the sewn together panel at an angle to the edge sewn seams into elongate sections;

shifting every other section longitudinally a distance generally equal to the width of the cut sections; and edge sewing the sections together to form a two sided fur blanket.

2. The method of claim 1 wherein the fur pelts are cut into elongated strips having a width generally equal to the length of the fur on the fur side.

3. The method of claim 2 wherein the angle at which the elongate sections are cut is generally 90 degrees to the edge sewn seams.

4. The method of claim 2 wherein the angle at which the elongate sections are cut is generally 45 degrees to the edge sewn seams.

5. The method of claim 1 wherein at least two different pelts are used and aligning the elongated strips includes alternating the types of pelts placed side by side so that one type of fur is on one side and the other type of fur is on the other side.

6. The method of claim 1 including the step of attaching a lining to the pelts before the cutting.

7. A method of making a fur product from dressed animal pelts having fur and leather sides, and fabric, the method comprising the steps of:

cutting the fur pelts into elongated strips of generally equal width;

cutting the fabric into elongated strips of a width generally equal to the width of the elongated fur pelt strips;

aligning the elongated strips alternating the placement of the fur and the fabric, fur, fabric, fur, fabric, and so on with the fur up;

edge sewing the aligned strips together to form a panel;

cutting the sewn together panel at an angle to the edge sewn seams into elongate sections;

shifting every other section longitudinally a distance generally equal to the width of the cut sections; and edge sewing the sections together to form a fur blanket, so that the fur is on one side and the other side is void of fur.

8. A fur product comprising:

dressed fur pelts cut into elongated strips of generally equal width;

said strips being aligned in an alternating fur up, leather up, fur up, leather up repeating pattern;

said aligned strips being edge sewn together to form a panel;

said panel being cut into elongate sections at an angle to the edge sewn seams;

every other of said elongate sections being shifted longitudinally a distance generally equal to the width of the cut sections; and said sections being sewn together to form a two sided fur blanket.

9. The fur product of claim 8 comprising at least two types of fur pelts aligned with alternating types of pelts placed side by side so that one type of fur is on one side and the other type of fur is on the other side.

10. A fur product comprising:

dressed fur pelts cut into elongated strips of generally equal width;

fabric being cut into elongated strips of a width generally equal to the width of the cut fur pelt strips;

said strips being aligned alternating the placement of the fur and the fabric with the fur up in a repeating pattern;

said aligned strips being edge sewn together to form a panel;

said panel being cut into elongate sections at an angle to the edge sewn seams;

every other of said elongate sections being shifted longitudinally a distance generally equal to the width of the cut sections; and said sections being sewn together to form a fur blanket, so that the fur is on one side and the other side is void of fur.

* * * * *